US005773676A

United States Patent [19]

Drake et al.

[11] Patent Number: 5,773,676

[45] Date of Patent: Jun. 30, 1998

[54] PROCESS FOR PRODUCING OLEFINS AND AROMATICS FROM NON-AROMATICS

[75] Inventors: Charles A. Drake, Nowata; Edward L. Sughrue, II; James B. Kimble, both of Bartlesville, all of Okla.

[73] Assignee: Phillips Petroleum Company, Bartlesville, Okla.

[21] Appl. No.: 692,218

[22] Filed: Aug. 6, 1996

[51] Int. Cl.[6] ..... C07C 15/00; C10G 51/02

[52] U.S. Cl. ..... 585/322; 585/324; 585/407; 208/64; 208/66; 208/74; 208/76

[58] Field of Search ..... 585/322, 324, 585/407; 208/64, 66, 74, 76

[56] References Cited

U.S. PATENT DOCUMENTS

| | | | |
|---|---|---|---|
| 3,813,330 | 5/1974 | Givens et al. | 208/66 |
| 3,827,867 | 8/1974 | Heinemann et al. | 48/211 |
| 3,827,968 | 8/1974 | Givens et al. | 208/49 |
| 3,894,934 | 7/1975 | Owen et al. | 208/78 |
| 4,097,367 | 6/1978 | Haag et al. | 208/135 |
| 4,554,393 | 11/1985 | Liberts et al. | 585/322 |
| 4,582,949 | 4/1986 | Kieffer | 585/312 |
| 4,746,763 | 5/1988 | Kocal | 585/417 |
| 4,788,364 | 11/1988 | Harandi | 585/322 |
| 4,879,424 | 11/1989 | Harandi | 585/322 |
| 5,004,852 | 4/1991 | Harandi | 585/322 |
| 5,227,555 | 7/1993 | Rhoe et al. | 585/322 |
| 5,292,976 | 3/1994 | Dessau et al. | 585/322 |

OTHER PUBLICATIONS

"A Process for Aromatization of Light Hydrocarbons", Nal Y. Chen et al., *Industrial & Engineering Chemistry Process Design and Development*, vol. 25, IEPDAW 25 (1–4) 1–1054 (1986), ISSN 0196–4305, pp. 151–155 (No Month).

*Primary Examiner*—Walter D. Griffin
*Attorney, Agent, or Firm*—Charles W. Stewart

[57] ABSTRACT

A multi-step process for converting non-aromatic hydrocarbons (preferably a gasoline-type hydrocarbon mixture) to lower olefins (preferably, ethylene and propylene) and aromatic hydrocarbons (preferably benzene, toluene and xylene) comprises, in sequence, a first reaction step, a first separation step, a second reaction step, and a second separation step, wherein the reaction severity of the first reaction step is lower than in the second reaction step so as to maximize olefins and aromatics yields.

8 Claims, 1 Drawing Sheet

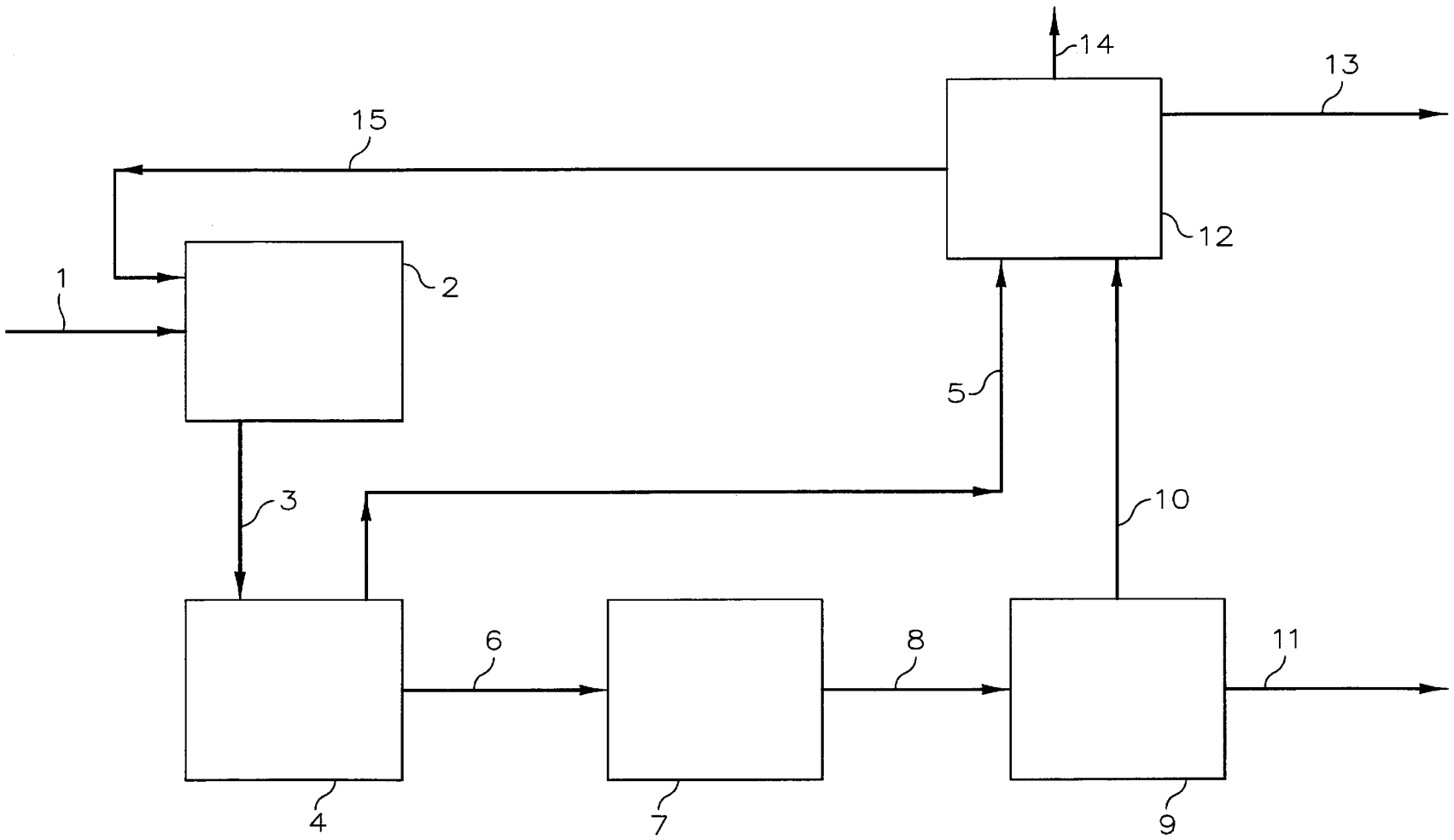
1
2
3
4
5
6
7
8
9
10
11
12
13
14
15

PROCESS FOR PRODUCING OLEFINS AND AROMATICS FROM NON-AROMATICS

BACKGROUND OF THE INVENTION

This invention relates to a multi-step process for converting non-aromatic hydrocarbons in the presence of a zeolite-containing catalyst to lower olefins and aromatic hydrocarbons and producing a high purity aromatic hydrocarbon stream especially without costly extractive procedures.

It is known to catalytically crack non-aromatic gasoline-range hydrocarbons to lower olefins (such as propylene) and aromatic hydrocarbons (such as benzene, toluene, xylenes) in the presence of catalysts which contain a zeolite (such as ZSM-5), as is described in an article by N. Y. Chen et al in Industrial & Engineering Chemistry Process Design and Development, Volume 25, 1986, pages 151–155. The reaction product of this catalytic cracking process contains a multitude of hydrocarbons: unconverted $C_5$+ alkanes, lower alkanes (methane, ethane, propane), lower alkenes (ethylene and propylene), $C_6$–$C_8$ aromatic hydrocarbons (benzene, toluene, xylenes, and ethylbenzene), and $C_9$+ aromatic hydrocarbons.

A particular concern relating to the conversion of hydrocarbons in the gasoline boiling range to aromatic hydrocarbons and lower olefins when utilizing a zeolite type catalyst is the inability to produce a high purity aromatic product stream without the need to use costly extractive separation procedures. This difficulty in separating the aromatics is due to the presence of aromatic boiling range, non-aromatic hydrocarbons in the reaction product of the zeolite catalyzed conversion process. It can be desirable for the reaction product from the zeolite catalyzed conversion of gasoline boiling range hydrocarbons to have a composition so that the aromatic hydrocarbons of the reaction product, particularly benzene, toluene, xylene and ethylbenzene, can be separated by utilizing conventional distillation methods without the need to use solvent extraction techniques or other costly extractive separation procedures.

The present invention is directed to an improved, multi-step process for maximizing the yields of valuable products such as lower olefins (in particular ethylene and propylene) and BTX aromatics. An additional aspect of the present invention is utilizing the improved multi-step process to produce a high purity aromatic product, especially without the need to utilize expensive extraction techniques.

SUMMARY OF THE INVENTION

It is an object of this invention to at least partially convert hydrocarbons contained in gasoline to ethylene, propylene and BTX (benzene, toluene, xylene and ethylbenzene) aromatics.

A further object of this invention is to provide a multi-step process for producing lower olefins and aromatic hydrocarbons from non-aromatic hydrocarbons (in particular paraffins) and then recovering the produced lower olefins and aromatic hydrocarbons.

A still further object of this invention is to provide a multi-step process which utilizes a zeolite catalyst.

Other objects and advantages will become apparent from the detailed description and the appended claims.

The inventive process provides for the production of lower olefins and a high purity aromatic stream from a hydrocarbon feedstock. The hydrocarbon feedstock, containing at least one non-aromatic hydrocarbon containing 5–16 carbon atoms per molecule selected from the group consisting of alkanes, alkenes, and cycloalkanes, is contacted with a first zeolite catalyst in a first reaction zone under reaction conditions such that the weight hourly space velocity of the hydrocarbon feedstock exceeds about 5 $hour^{-1}$. From this contact step, a first reaction product is produced and is separated into a first lower boiling fraction containing hydrogen gas, lower alkanes and lower alkenes, and a first higher boiling fraction, containing aromatic hydrocarbons. The first higher boiling fraction is contacted with a second zeolite catalyst in a second reaction zone under reaction conditions such that the weight hourly space velocity of the first higher boiling fraction is less than 10 $hour^{-1}$ so as to produce a second reaction product. The second reaction product is separated into a second lower boiling fraction, containing hydrogen gas, lower alkanes and lower alkenes, and a second higher boiling fraction, containing at least about 80 weight percent BTX aromatics.

BRIEF DESCRIPTION OF THE DRAWING

The drawing depicts a flow diagram for a preferred embodiment of the multi-step process of this invention.

DETAILED DESCRIPTION OF THE INVENTION

Any catalyst containing a zeolite which is effective in the conversion of non-aromatics to aromatics can be employed in the contacting steps of the inventive process. Preferably, the zeolite component of the catalyst has a constraint index (as defined in U.S. Pat. No. 4,097,367) in the range of about 0.4 to about 12, preferably about 2–9. Generally, the molar ratio of $SiO_2$ to $Al_2O_3$ in the crystalline framework of the zeolite is at least about 5:1 and can range up to infinity. Preferably, the molar ratio of $SiO_2$ to $Al_2O_3$ in the zeolite framework is about 8:1 to about 200:1, more preferably about 12:1 to about 60:1. Preferred zeolites include ZSM-5, ZSM-8, ZSM-11, ZSM-12, ZSM-35, ZSM-38, and mixtures thereof. Some of these zeolites are also known as "MFI" or "Pentasil" zeolites. It is within the scope of this invention to use zeolites which contain boron and/or at least one metal selected from the group consisting of Ga, In, Zn, Cr, Ge and Sn. The presently more preferred zeolite is ZSM-5.

The catalyst generally also contains an inorganic binder (also called matrix material), preferably selected from the group consisting of alumina, silica, alumina-silica, aluminum phosphate, clays (such as bentonite), and mixtures thereof. Optionally, other metal oxides, such as magnesia, ceria, thoria, titania, zirconia, hafnia, zinc oxide and mixtures thereof, which enhance the thermal stability of the catalyst, may also be present in the catalyst. Preferably, hydrogenation promoters such as Ni, Pt, Pd, other Group VIII noble metals, Ag, Mo, W and the like, should essentially be absent from the catalyst (i.e., the total amount of these metals should be less than about 0.1 weight-%). Generally, the content of the zeolite component in the catalyst is about 1–99 (preferably about 10–50) weight-%, and the content of the above-listed inorganic binder and metal oxide materials in the zeolite is about 1–50 weight-%. Generally, the zeolite component of the catalyst has been compounded with binders and subsequently shaped (such as by pelletizing, extruding or tableting). Generally, the surface area of the catalyst is about 50–700 $m^2/g$, and its particle size is about 1–10 mm.

Any suitable hydrocarbon feedstock which comprises paraffins (alkanes) and/or olefins (alkenes) and/or naphthenes (cycloalkanes), wherein each of these hydrocarbons contains 5–16 carbon atoms per molecule can be used as the feed to the first contacting step of this invention. Frequently these feedstocks also contain aromatic hydrocarbons. Non-limiting examples of suitable, available feedstocks include gasolines from catalytic oil cracking (e.g., FCC) processes, pyrolysis gasolines from thermal hydrocarbon (e.g., ethane) cracking processes, naphthas, gas oils, reformates and the like. The preferred feed is a hydrocarbon feedstock suitable for use as at least a gasoline blend stock generally having a boiling range of about 30°–210° C. Examples of suitable feed materials are those having the compositions of Stream 1 listed in Tables I and II. Generally, the content of paraffins exceeds the combined content of olefins, naphthenes and aromatics (if present).

The hydrocarbon-containing feeds can be contacted by any suitable manner with the solid zeolite-containing catalyst contained within the reaction zones of the invention. Each of the contacting steps can be operated as a batch process step or, preferably, as a continuous process step. In the latter operation, a solid catalyst bed or a moving catalyst bed or a fluidized catalyst bed can be employed. Any of these operational modes have advantages and disadvantages, and those skilled in the art can select the one most suitable for a particular feed and catalyst. No significant amount of hydrogen gas is required to be introduced with the feed into the reactor zones of the contacting steps, i.e., no $H_2$ gas at all or only insignificant trace amounts of $H_2$ (e.g., less than about 1 ppm $H_2$) which do not significantly affect the processes are to be introduced into these reactors from an external source.

An important aspect of the inventive process is for the first reaction stage, or first contacting step, to be operated at a low to moderate reaction severity and for the second reaction stage, or second contacting step, to be operated at a high reaction severity. It is especially important for the first reaction stage to operate at a low to moderate severity because it provides a reaction product having the necessary characteristics that allow the higher boiling fraction therefrom to be processed in the second reaction stage, operated under high severity reaction conditions, to give a second reaction product having a second higher boiling fraction that is high in BTX aromatic hydrocarbon concentration.

Another essential aspect of the invention is for the second reaction stage to operate at as high a reaction severity as is commercially practical due to the improved aromatic hydrocarbon purity of the second higher boiling fraction that results from such operation. It is the unique combination of operating the first reaction stage at a low to moderate reaction severity and passing at least a portion of its reaction product, preferably the higher boiling fraction, to the second reaction stage operated at a high reaction severity so as to provide for a high purity aromatic stream end-product.

The first contacting step of the inventive process is generally carried out at a reaction temperature of less than about 650° C., at a reaction pressure as low as is commercially practical, and a weight hourly space velocity ("WHSV") exceeding about 5 $hour^{-1}$. The term weight hourly space velocity, as used herein, shall mean the numerical ratio of the rate at which a hydrocarbon feed is charged to a reaction zone in pounds per hour divided by the pounds of catalyst contained within the reaction zone to which the hydrocarbon is charged. The reaction temperature of the first contacting step more specifically can be in the range of from about 400° C. to about 600° C. and, most preferably, it can be in the range of from 450° C. to 550° C.

The weight hourly space velocity of hydrocarbon feedstock to the first reaction zone is important in setting the severity of the first reaction stage and in providing for the first reaction stage reaction product having the important characteristics for further processing in the second reaction stage of the inventive process. A high WHSV provides for a less severe reaction condition. Therefore, the WHSV of the hydrocarbon feedstock to the first reaction stage should generally exceed about 5 $hour^{-1}$ and, more practically, being in the range of from about 5 $hour^{-1}$ to about 200 $hour^{-1}$. Preferably, the WHSV of the hydrocarbon feedstock to the first reaction zone can be between about 10 $hour^{-1}$ to about 50 $hour^{-1}$ and, most preferably, the WHSV can be from 15 $hour^{-1}$ to 25 $hour^{-1}$.

The reaction pressure of the first reaction stage should be as low as practical, but generally, it can be in the range of from about 2 psia to about 50 psia. Preferably, the first reaction stage pressure can be in the range of from about 5 psia to about 30 psia and, more preferably, it can be in the range of from 10 to 20 psia.

It is also an essential aspect of the inventive process for the second reaction stage, or second contacting step, to be operated at a high reaction severity so as to provide a second reaction product that has a small fraction of non-aromatic hydrocarbons having boiling temperatures near or in the range of the boiling temperatures of BTX aromatics. It is the combination of the specific properties of the first reaction stage product charged to the second reaction stage along with the high reaction severity of the second reaction stage that provides for a high purity aromatic end-product. This is achieved by reducing the amount of the non-aromatic hydrocarbons having boiling temperatures in the BTX aromatic boiling temperature range that is found in the second reaction stage product. The second contacting step is then generally carried out at a reaction temperature exceeding about 500° C., at a reaction pressure as high as commercially practical, and a WHSV less than about 10 $hour^{-1}$. The reaction temperature of the second contacting step preferably can be in the range of from about 500° C. to about 800° C. and, more preferably, it can be in the range of from 550° C. to 700° C.

To provide for a high severity, the WHSV of the feed to the second reaction stage should generally be less than about 10 $hour^{-1}$ and more practically being in the range of from exceeding 0 $hour^{-1}$ to about 10 $hour^{-1}$. Preferably, the WHSV of the feed to the second reaction stage is in the range of from about 0.25 $hour^{-1}$ to about 5 $hour^{-1}$ and, more preferably, the WHSV can be in the range of from 0.5 $hour^{-1}$ to 2 $hour^{-1}$.

The reaction pressure of the second reaction stage should be as high as practical, but generally, it can be in the range of from about 50 psia to about 500 psia. Preferably, the second reaction stage pressure can be in the range of from about 100 psia to about 500 psia and, more preferably, it can be in the range of from 150 psia to 500 psia.

It is preferred to maximize the production of lower olefins (ethylene and propylene) in the first reaction stage and to maximize the purity of the BTX aromatics product produced in the second reaction stage. This is accomplished by adjusting the severity of each of the two reaction stages so as to give a second reaction stage product having a higher boiling fraction having a concentration of at least about 80 weight percent BTX aromatic hydrocarbons. Preferably, this high purity BTX aromatic product stream can have a concentration of at least about 95 weight percent, and most preferably, the concentration can exceed 99 weight percent. To accomplish the above, in addition to adjusting the reaction severity of the two reaction stages, the second contacting step can be operated at a WHSV of at least about 2 $hour^{-1}$ below the WHSV of the first contacting step. Also, the reaction pressure of the second contacting step can be maintained at 10 psi higher than the reaction pressure of the first contacting step.

The separation steps, can be carried out under any suitable process conditions. The specific parameters of separation steps depend on numerous variables, such as the specific compositions of the products produced in the reaction steps, the temperature and pressure conditions in the exit regions of the two reaction stages, the flow rates of the products, and the like. It is within the capabilities of persons of ordinary skills in the field of separation technology to select those specific separation parameters, including the types and dimensions of separation units, the pressure conditions, the temperature profiles within the units, reflux and reboiler ratios in distillation columns (when employed), and the like. The preferred method for separation is conventional distillation or flash separation and, indeed, the unexpected benefit of the inventive process is the ability to separate the second stage reaction product into a high purity aromatic stream (i.e., higher boiling fraction) by conventional distillation or flash separation methods without use of costly extractive techniques.

A preferred embodiment of this invention is shown in the drawing. Fluid feed stream 1 (preferably a gasoline fraction from a FCC oil cracker) is introduced into first conversion reactor 2 (preferably a fluidized catalytic cracking reactor) in which the feed is contacted with a zeolite catalyst (preferably one which contains a ZSM-5 zeolite) at effective conversion (cracking) conditions. Reactor effluent stream 3 is introduced into first separator 4 (generally a flash evaporation unit) in which the reactor effluent stream is separated into first lower-boiling stream 5 and first higher-boiling stream 6, generally by operating this first separator at a pressure below the reaction pressure employed in the first reactor.

The higher-boiling liquid stream 6 is introduced into second conversion reactor 7 (preferably a fluidized catalytic cracking reactor) in which stream 6 is contacted with a zeolite catalyst (preferably one which contains a ZSM-5 zeolite) at effective conversion (cracking) conditions. Reactor effluent stream 8 is introduced into second separator 9 (generally a flash evaporator or a distillation column) in which reactor effluent stream 8 is separated into second lower-boiling stream 10 and second higher-boiling stream 11. Preferably, stream 11 is further fractionated to obtain one stream containing primarily $C_6$–$C_8$ aromatics (BTX) and another one containing primarily higher-boiling $C_9$+ aromatics.

Approximate compositions of the various process streams identified in the drawing are summarized in Tables I and II.

TABLE I

| | Broad Ranges of Weight Percentage of Compounds in | | | | | | |
|---|---|---|---|---|---|---|---|
| Compound | Stream 1 | Stream 3 | Stream 5 | Stream 6 | Stream 8 | Stream 10 | Stream 11 |
| Hydrogen | 0 | 0.1–1.5 | 0.2–3 | 0 | 0.1–1.5 | 0.5–3 | 0 |
| Methane | 0 | 1–5 | 2–10 | 0 | 0.5–5 | 3–25 | 0 |
| Ethane/Propane | 0 | 2–8 | 4–16 | 0 | 1–8 | 10–40 | 0 |
| Ethylene | 0 | 5–10 | 10–20 | 0 | 2–10 | 10–50 | 0 |
| Propylene | 0 | 10–25 | 20–50 | 0 | 5–15 | 15–50 | 0 |
| $C_4$ Alkanes | 0 | 0.1–5 | 0.2–10 | 0 | 0.1–5 | 0.5–20 | 0 |
| $C_4$ Alkenes | 0 | 2–10 | 4–20 | 0 | 1–6 | 5–20 | 0 |
| $C_6$- Non-Aromatics[1] | 20–50 | 10–30 | 14–45 | 5–20 | 1–15 | 2–20 | 0.5–5 |
| $C_6$–$C_9$ Non-Aromatics | 10–50 | 2–25 | 0 | 4–50 | 2–25 | 0 | 3–30 |
| Benzene | 0–10 | 1–15 | 0 | 2–30 | 2–35 | 0 | 5–40 |
| Toluene | 0–20 | 5–30 | 0 | 10–50 | 15–50 | 0 | 15–50 |
| Ethylbenzene | 0–10 | 0–5 | 0 | 0–10 | 0–5 | 0 | 0–5 |
| m-/p-xylenes | 0–20 | 2–30 | 0 | 4–60 | 4–40 | 0 | 5–40 |
| o-xylene | 0–10 | 1–15 | 0 | 2–30 | 2–25 | 0 | 2–25 |
| $C_9$+ Hydrocarbons | 0–502 | 5–303 | 0 | 10–60[3] | 5–404 | 0 | 5–504 |

[1]Non-aromatic $C_4$, $C_5$ and $C_6$ hydrocarbons, such as paraffins, olefins and cycloparaffins.
[2]Complex mixture of paraffins, olefins, naphthenes and aromatics containing 9 or more C atoms per molecule.
[3]Primarily linear paraffins and aromatics containing 9 or more C atoms per molecule.
[4]Primarily aromatics containing 9–10 C atoms per molecule.

TABLE II

| | Narrow Ranges of Weight Percentage of Compounds in | | | | | | |
|---|---|---|---|---|---|---|---|
| Compound | Stream 1 | Stream 3 | Stream 5 | Stream 6 | Stream 8 | Stream 10 | Stream 11 |
| Hydrogen | 0 | 0.1–0.5 | 0.3–0.5 | 0 | 0.2–0.5 | 0.5–2 | 0 |
| Methane | 0 | 1–3 | 3–5 | 0 | 1–4 | 7–12 | 0 |
| Ethane/Propane | 0 | 3–5 | 8–10 | 0 | 2–5 | 12–17 | 0 |
| Ethylene | 0 | 6–8 | 12–18 | 0 | 3–7 | 20–25 | 0 |
| Propylene | 0 | 11–15 | 25–30 | 0 | 4–8 | 25–30 | 0 |
| $C_4$ Alkanes | 0 | 0.5–2 | 1–4 | 0 | 0.5–2 | 3–5 | 0 |
| $C_4$ Alkenes | 0 | 6–10 | 15–20 | 0 | 2–4 | 12–16 | 0 |
| $C_6$- Non-Aromatics[1] | 30–35 | 12–20 | 20–30 | 10–15 | 2–5 | 8–12 | 0.5–2 |
| $C_6$–$C_9$ | 20–30 | 6–10 | 0 | 12–16 | 4–8 | 0 | 6–10 |

TABLE II-continued

| Compound | Narrow Ranges of Weight Percentage of Compounds in | | | | | | |
|---|---|---|---|---|---|---|---|
| | Stream 1 | Stream 3 | Stream 5 | Stream 6 | Stream 8 | Stream 10 | Stream 11 |
| Non-Aromatics | | | | | | | |
| Benzene | 1–4 | 2–6 | 0 | 5–10 | 7–12 | 0 | 10–15 |
| Toluene | 4–8 | 8–15 | 0 | 15–25 | 20–28 | 0 | 25–35 |
| Ethylbenzene | 1–4 | 0.5–1.5 | 0 | 1–4 | 0.5–2 | 0 | 0.5–2 |
| m-/p-xylenes | 4–8 | 5–10 | 0 | 10–15 | 10–15 | 0 | 12–18 |
| o-xylene | 1–4 | 1–4 | 0 | 2–6 | 3–6 | 0 | 3–8 |
| $C_9$+ Hydrocarbons | 20–30[2] | 12–20[3] | 0 | 25–35[3] | 20–25[4] | 0 | 25–30[4] |

[1]Non-aromatic $C_4$, $C_5$ and $C_6$ hydrocarbons, such as paraffins, olefins and cycloparaffins.
[2]Complex mixture of paraffins, olefins, naphthenes and aromatics containing 9 or more C atoms per molecule.
[3]Primarily linear paraffins and aromatics containing 9 or more C atoms per molecule.
[4]Primarily aromatics containing 9–10 C atoms per molecule.

In a particular embodiment, product streams 5 and 10 containing the lower-boiling (gaseous) reaction products are introduced into separation system 12 which comprises a multitude (preferably about 3–5) fractional distillation columns in which these reaction products are further separated. The specific operating parameters of each of the employed distillation columns can be easily determined by those skilled in the art. In this separation system 12, the lower-boiling products are preferably separated into one (or more than one) stream (labeled 13) containing the more valuable monoolefins (in particular ethylene and propylene), one or more than one stream (labeled 14) containing less valuable light gases (in particular hydrogen, methane, ethane and propane), and one (or more than one) stream (labeled 15) containing $C_4$, $C_5$ and $C_6$ hydrocarbons (in particular butanes, pentanes, hexanes, butenes, pentenes, hexenes, cyclopentane, methylcyclopentane, cyclohexane, cyclopentene, methylcyclopentene and cyclohexene). Preferably, the at least one stream 15 is recycled as co-feed to first reactor 2.

The following examples are presented to further illustrate this invention and should not be construed as unduly limiting the scope of this invention.

EXAMPLE I

This example illustrates some of the preferred operating parameters for the first reactor of the multi-step process of this invention for converting gasoline (e.g., produced in a commercial FCC oil cracking unit) to higher value products, in particular, ethylene, propylene and BTX (benzene, toluene, xylenes).

A sample of 2.5 g of a commercial ZSM-5 catalyst (provided by United Catalysts Inc., Louisville, Ky., under the product designation "T-4480"), which had been steam-treated for several hours, was mixed with about 5 cc 10–20 mesh alumina. This mixture was placed into a stainless steel tube reactor (length: about 18 inches; inner diameter: about 0.5 inch). Gasoline (density: 0.73 g/cc; having the approximate composition of Stream 1 in Table II) from a catalytic cracking unit of a refinery was passed through the reactor at a flow rate of about 18.3 g/hour, at a temperature of about 600° C. and atmospheric pressure (about 0 psig). Thus, the weight hourly space velocity (WHSV) of the liquid feed was about 7.3 $hr^{-1}$. The formed reaction product exited the reactor tube and passed through several ice-cooled traps. The liquid portion remained in these traps and was weighed, whereas the volume of the gaseous portion which exited the traps was measured in a "wet test meter". Eight liquid and gaseous product samples (collected at hourly intervals) were analyzed by means of a gas chromatograph. A representative invention run (duration: about 8 hours), which was carried out at the above reaction conditions, produced the gaseous portion of the product at an average rate of about 5.7 l/hour (about 0.7 l/hour hydrogen and about 5.0 l/hour light hydrocarbons) and the liquid portion of the product at an average rate of about 10.0 g/hour. The hydrocarbon contents in both product portions are summarized in Table III.

TABLE III

| Hydrocarbon Distribution in Gaseous Portion of Product | | Distribution of Hydrocarbons in Liquid Portion of Product | |
|---|---|---|---|
| Compound | Weight-%[1] | Compound | Weight-% |
| Methane | 3.4 | Lights[3] | 19.5 |
| Ethane | 4.0 | Benzene | 6.8 |
| Ethylene | 20.6 | Toluene | 19.5 |
| Propane | 7.4 | Ethylbenzene | 1.0 |
| Propylene | 33.2 | m-Xylene | 13.1 |
| Isobutane | 1.7 | o-Xylene | 4.4 |
| n-Butane | 1.6 | p-Xylene | 0 |
| Butenes | 14.3 | $C_6$–$C_8$ Nonaromatics | 8.1 |
| $C_5$+ Nonaromatics[2] | 12.7 | Heavies[4] | 27.5 |
| Benzene | 1.0 | | |

[1]Based on weight of hydrocarbons only (i.e., total gaseous products minus $H_2$).
[2]Primarily $C_5$ and $C_6$ alkanes, alkenes and cycloalkanes.
[3]Primarily $C_4$, $C_5$ and some $C_6$ alkanes, alkenes and cycloalkanes.
[4]Primarily $C_9$+ aromatic and nonaromatic hydrocarbons.

The above test results indicate that a combination of relatively high WHSV of the feed (about 7 $hr^{-1}$) and a relatively high temperature (about 600° C.) were effective reaction conditions for generating relatively large amounts of valuable light monoolefins (ethylene and propylene) in the first reactor. This light monoolefins fraction comprised over 50% of the gaseous products.

A control run also employing a ZSM-5 catalyst which was carried out at a lower temperature (500° C.) and a lower WHSV (0.6 $hr^{-1}$) yielded considerably less of the valuable lower monoolefins and considerably more of the less valuable lower paraffins. The gaseous portion of the reaction product of this control run contained 0.7 weight-% ethylene, 1.2 weight-% propylene, 8.7 weight-% ethane and 55.5 weight-% propane.

EXAMPLE II

This example illustrates some of the preferred operating parameters for the second reactor of the multi-step process of this invention.

Gasoline from a FCC oil cracking unit of a refinery was converted to monoolefins and aromatics in the test reactor described in Example I. The employed catalyst had been prepared by blending 300 g of a Zeocat ZSM-5 catalyst (marketed by Chemie Uetikon AG, Uetikon, Switzerland, under the product designation "PZ-2/50H"), 9.4 g bentonite clay, 80 g aluminum Chlorhydrol® (a hydroxy aluminum chloride solution described in Example I of U.S. Pat. No. 4,775,461) and 215.4 distilled water. The obtained mixture was dried (for 3 hours at 122° C.), calcined in air for 3 hours at 500° C., and steam-treated. About 2.5 g of the catalyst material was mixed with 5 cc 10–20 mesh alumina, and the mixture was placed into a stainless steel tube reactor. Reaction conditions were: a liquid feed rate ranging from about 29 g/hour to about 58 g/hour (i.e., WHSV of about 11.6 $hr^{-1}$ to about 23.2 $hr^{-1}$); pressure: ranging from atmospheric (0 psig) to 250 psig; and temperature: about 500° C. The average production rate of gaseous products (mainly $H_2$, $C_1$–$C_5$ alkanes, $C_1$–$C_4$ alkenes) was about 10 l/hr. The average production rate of liquid products (mainly aromatic and nonaromatic hydrocarbons containing 6 and more carbon atoms per molecule) was about 17 g/hour when the feed rate was about 29 g/hour, and was about 35 g/hour when the feed rate was about 58 g/hour. Pertinent test results are summarized in Table IV.

TABLE IV

| Time in Stream (Hours) | Reaction Pressure (psig) | Wt-% in Liquid Product: Light Fraction[1] | Middle Fraction[2] | Heavy Fraction[3] | Wt-% in Middle Fraction: BTX[4] | Non-Aromatics[5] |
|---|---|---|---|---|---|---|
| 0.5 | 0 | 4.7 | 67.9 | 27.4 | 95.1 | 4.9 |
| 1.0 | 0 | 5.1 | 68.8 | 26.1 | 97.8 | 2.2 |
| 2.5 | 100 | 2.3 | 66.0 | 31.7 | 98.6 | 1.4 |
| 3.5 | 200 | 1.5 | 63.3 | 35.2 | 99.4 | 0.6 |
| 4.5 | 200 | 2.1 | 61.7 | 36.2 | 99.4 | 0.6 |
| 5.5 | 250 | 1.6 | 61.2 | 37.2 | 98.9 | 1.1 |
| 6.5 | 250 | 1.4 | 62.5 | 36.1 | 98.6 | 1.4 |

[1]Primarily hydrocarbons containing less than 6 carbon atoms per molecule.
[2]Primarily hydrocarbons containing 6–8 carbon atoms per molecule.
[3]Primarily hydrocarbons containing more than 8 carbon atoms per molecule.
[4]Primarily benzene, and xylenes; and about 2 weight-% ethylbenzene.
[5]Primarily linear alkanes containing 6–8 carbon atoms per molecule.

Test data in Table IV clearly show the beneficial effect of a relatively high reaction pressure: the most valuable liquid middle fraction (which can be easily separated from the lights and heavies fractions, e.g., by fractional distillation) contained more of the desirable BTX aromatics and less of the undesirable non-aromatics (primarily paraffins).

EXAMPLE III

This example illustrates the improvement in BTX product purity associated with operating the reaction stages as described herein with a low WHSV.

A gasoline feedstock was passed over a zeolite catalyst under cracking reaction conditions and at two different weight hourly space velocities of 2.95 $hr^{-1}$ and 28.2 $hr^{-1}$. The experimental data from this experiment is presented in Table V.

A sample of 2.54 g of commercial steam treated Zeocat ZSM-5 catalyst was charged to a 0.75 inch quartz reactor. After heating and purging the reactor with nitrogen gas, the gasoline feedstock was introduced into the reactor at such rates as to provide the aforementioned WHSV. The reactors were maintained at a temperature of about 550° C. under atmospheric pressure.

The formed reaction product exited the reactor tube and passed through several ice-cooled traps. The liquid portion remained in these traps and was weighed, whereas the volume of the gaseous portion which exited the traps was measured in a "wet test meter". Liquid and gaseous product samples were analyzed by means of a gas chromatograph. The hydrocarbon contents in both product portions are summarized in Table V.

TABLE V

| | Feed | Run A | Run B |
|---|---|---|---|
| Flow Rate (g/hr) | | 7.5 | 71.6 |
| Catalyst Weight (g) | | 2.54 | 2.54 |
| WHSV ($hr^{-1}$) | | 2.95 | 28.2 |
| Temperature (°C.) | | 550 | 550 |
| Pressure (psig) | | 0 | 0 |
| Composition of Gas Portion of Product | | | |
| H2, vol % | | 16.32 | 7.23 |
| C1, wt % non-H2 gas | | 6.28 | 1.69 |
| C2, wt % non-H2 gas | | 7.71 | 2.14 |
| C2=, wt % non-H2 gas | | 19.82 | 19.55 |
| C3, wt % non-H2 gas | | 12.23 | 3.99 |
| C3=, wt % non-H2 gas | | 27.49 | 37.98 |
| I-C4, wt % non-H2 gas | | 2.64 | 1.12 |

TABLE V-continued

| | Feed | Run A | Run B |
|---|---|---|---|
| n-C4, wt % non-H2 gas | | 2.39 | 1.19 |
| C4=, wt % non-H2 gas | | 10.13 | 14.01 |
| C5=, wt % non-H2 gas | | 11.32 | 18.33 |
| gas weight, g (calc) | | 1.88 | 14.13 |
| Composition of Liquid Portion of Product | | | |
| Lights, wt % | 15.35 | 9.3 | 15.43 |
| Benz, wt % | 3.4 | 7.21 | 4.37 |
| Tol, wt % | 11.47 | 22.43 | 14.58 |
| EB, wt % | 2.19 | 1.32 | 1.63 |
| p-Xyl, wt % | 10.97 | 15.85 | 12.39 |
| m-Xyl, wt % | 0 | 0 | 0 |
| o-Xyl, wt % | 3.75 | 5.34 | 4.18 |
| Non-Arom/BTX, wt % | 16.16 | 4.06 | 11.55 |
| Heavies, wt % | 36.72 | 34.48 | 35.88 |
| Liquid weight, g | | 4.91 | 62.3 |
| Mass Balance (calc) | | 90.54 | 106.74 |
| BTX Purity, wt % | 66.3 | 92.8 | 76.3 |

The above test results indicate that a low WHSV, as compared to a significantly higher WHSV, provides for a substantially higher purity BTX product. Run A, having a WHSV of 2.95 $hour^{-1}$, gave a BTX product purity of 92.8 percent as opposed to the much lower BTX product purity of 76.3 percent for Run B having a WHSV of 28.2 $hour^{-1}$. These data demonstrate the importance of operating the second reaction stage of the inventive process at a significantly lower WHSV than that of the first reaction stage of the process.

Reasonable variations, modifications and adaptations for various operations and conditions can be made within the scope of the disclosure and the appended claims without departing from the scope of this invention.

That which is claimed is:

1. A process for producing and controlling the purity of a high purity aromatic stream from a hydrocarbon feedstock, wherein the concentration of paraffins in said hydrocarbon feedstock exceeds the combined content of olefins, naphthenes and aromatics in said hydrocarbon feedstock, said process comprises the steps of:

contacting said hydrocarbon feedstock containing at least one non-aromatic hydrocarbon containing 5–16 carbon atoms per molecule selected from the group consisting of alkanes, alkenes and cycloalkanes with a first zeolite catalyst in a first reaction zone under reaction conditions such that the weight hourly space velocity of said hydrocarbon feedstock exceeds about 5 $hour^{-1}$ so as to produce a first reaction product;

separating said first reaction product into a first lower boiling fraction containing hydrogen gas, lower alkanes, and lower alkenes and a first higher-boiling fraction containing aromatic hydrocarbons;

contacting said first higher-boiling fraction with a second zeolite catalyst in a second reaction zone under reaction conditions such that the weight hourly space velocity of said first higher-boiling fraction is less than about 10 $hour^{-1}$ so as to produce a second reaction product;

separating said second reaction product into a second lower-boiling fraction containing hydrogen gas, lower alkanes, and lower alkenes and a second higher-boiling fraction containing aromatic hydrocarbons selected from the group consisting of benzene, toluene, xylene, ethylbenzene and mixtures of two or more thereof; and adjusting the reaction conditions of said first reaction zone and said second reaction zone such that the WHSV in said second reaction zone is at least about 2 $hour^{-1}$ below the WHSV in said first reaction zone and such that the pressure of said second reaction zone is maintained at 10 psi higher than the pressure of said first reaction zone, thereby providing for the production of said second higher boiling fraction having a concentration of aromatic hydrocarbons of at least about 80 weight percent.

2. A process as recited in claim 1 wherein the reaction conditions within said first reaction zone further include a first pressure of less than about 50 psia, and the reaction conditions within said second reaction zone further include a second pressure exceeding about 50 psia.

3. A process as recited in claim 2 wherein the reaction conditions within said first reaction zone further include a first temperature less than about 650° C., and the reaction conditions within said second reaction zone further include a second temperature exceeding about 500° C.

4. A process as recited in claim 3 wherein said second higher boiling fraction contains at least about 90 weight percent aromatics.

5. A process as recited in claim 4 wherein said second higher boiling fraction contains at least about 95 weight percent aromatics.

6. A process for converting non-aromatic hydrocarbons to lower olefins and aromatic hydrocarbons and controlling the purity of a high purity aromatic product stream said process comprises the steps of:

(1) contacting, essentially in the absence of added hydrogen gas, a fluid feed comprising at least one non-aromatic hydrocarbon containing 5–16 carbon atoms per molecule selected from the group consisting of paraffins, olefins and naphthenes, wherein the concentration of paraffins in said fluid feed exceeds the combined content of olefins, naphthenes and aromatics in said fluid feed, with a catalyst comprising at least one zeolite in a first reaction zone at effective cracking conditions comprising a reaction temperature of about 450°–650° C., a reaction pressure of about 2–50 psia and a weight hourly space velocity (WHSV) of said fluid feed of about 5–50 weight (lb.) feed per hour per weight (lb) of said catalyst, so as to produce a first reaction product comprising hydrogen gas, lower alkanes containing 1–5 carbon atoms per molecule, lower alkenes containing 2–5 carbon atoms per molecule, and aromatic hydrocarbons;

(2) separating said first reaction product into a first lower-boiling fraction comprising said hydrogen gas, said lower alkanes and said lower alkenes, and a first higher-boiling fraction comprising said aromatic hydrocarbons;

(3) contacting, essentially in the absence of added hydrogen gas, said first higher-boiling fraction from step (2) with a catalyst comprising at least one zeolite in a second reaction zone at effective cracking conditions comprising a reaction temperature of about 450°–650° C., a reaction pressure of about 50–500 psia and a weight hourly space velocity of about 0.5–10 weight (lb) of said first higher-boiling fraction per hour per weight (lb) of said catalyst, so as to produce a second reaction product comprising hydrogen gas, alkanes containing 2–5 carbon atoms per molecule, alkenes containing 2–5 carbon atoms per molecule, and aromatic hydrocarbons;

(4) separating said second reaction product into a second lower-boiling fraction containing said hydrogen gas, said alkanes and said alkenes, and a second higher-boiling fraction containing said aromatic hydrocarbons at a higher content than said first higher-boiling fraction used in step (3); and (5) adjusting the reaction conditions of said first reaction zone and said second reaction zone such that the WHSV in said second reaction zone is at least about 2 $hour^{-1}$ below the WHSV in said first reaction zone and such that the pressure of said second reaction zone is maintained at 10 psi higher than the pressure of said first reaction zone, thereby providing for the production of said second higher-boiling fraction having a concentration of aromatic hydrocarbons of at least about 80 weight percent.

7. A process in accordance with claim 6 wherein the concentration of said aromatic hydrocarbons in said second higher-boiling fraction exceeds about 90 weight percent.

8. A process in accordance with claim 7 wherein the concentration of said aromatic hydrocarbons in said second higher-boiling fraction exceeds about 95 weight percent.

* * * * *